United States Patent [19]

Shimme et al.

[11] 4,426,224

[45] Jan. 17, 1984

[54] LANCE FOR POWDER TOP-BLOW REFINING AND PROCESS FOR DECARBURIZING AND REFINING STEEL BY USING THE LANCE

[75] Inventors: Kaoru Shimme, Kyoto; Takeo Aoki, Kawanishi; Masayuki Taga, Kobe, all of Japan

[73] Assignee: Sumitomo Kinzoku Kogyo Kabushiki Gaisha, Osaka, Japan

[21] Appl. No.: 451,046

[22] Filed: Dec. 20, 1982

[30] Foreign Application Priority Data

Dec. 25, 1981 [JP] Japan ..... 56-215415
Aug. 19, 1982 [JP] Japan ..... 57-143778

[51] Int. Cl.[3] ..... C21C 7/10

[52] U.S. Cl. ..... 75/49; 75/52; 75/60; 266/268

[58] Field of Search ..... 75/49, 52, 60; 266/268

[56] References Cited

U.S. PATENT DOCUMENTS 3,304,173 2/1967 Smith ..... 75/52

*Primary Examiner*—Peter D. Rosenberg
*Attorney, Agent, or Firm*—Burns, Doane, Swecker and Mathis

[57] ABSTRACT

The invention relates to a refining lance used in blowing some additive into molten metal in a vacuum vessel when molten metal, such as molten steel, refined by employing a converter or electric furnace or the like is further refined into a metal having the desired composition. The lance includes a center hole for jetting the additive in the presence of gas and a plurality of side holes (Laval nozzle holes) for supply of accelerating gas so as to have the additive effectively added to the molten metal. The invention also proposes a method for producing low-carbon high-purity steels in molten state by using the refining lance.

7 Claims, 16 Drawing Figures

LANCE FOR POWDER TOP-BLOW REFINING AND PROCESS FOR DECARBURIZING AND REFINING STEEL BY USING THE LANCE

BACKGROUND OF THE INVENTION (1) Field of the Invention

The present invention relates to a powder top-blow refining lance for use in blowing a refining additive in powder form such as powder flux into molten metal such as molten steel under vacuum.

(2) Description of the Prior Art

Recently there is a growing demand for development of high-quality metallic materials. Such demand includes needs for improved mechanical properties and higher precision in the control of chemical components. A prevailing practice directed to meeting such demand is such that molten metal refined in a converter, electric furnace or any other suitable furnace is further refined under vacuum to produce a metal having the desired characteristics and composition.

For the purpose of such further refining, a refining additive in powder form is jetted through a top blowing lance onto the molten metal. Since the object of such top blow lancing is to pass the refining powder into the molten metal, it is essential to increase the flow velocity of the powder penetrating into the molten metal. Another consideration needed is to minimize possible wear of the lance interior. In order to meet these requirements there have been employed lances of single straight pipe type.

In connection with the use of lances of such conventional type various measures have been used to increase the flow velocity of the carrier gas in order to increase the flow velocity of the powder. With a lance of single straight-pipe structure, however, the difficulty is that the flow velocity of the gas, if increased, has its limit (which is Mach 1 at the most), that of the accompanying powder being inevitable lower than Mach 1. Moreover, the wear of the lance interior tends to increase proportionally as the flow velocity of the powder increases. Another difficulty is that since it is necessary to top blow from a certain or higher level above the surface of the molten metal allowing for thermal damages with the lance, the flow velocity of the powder tends to decrease appreciably before it reaches the surface of the molten metal, so that it does not allow sufficient penetration of the powder into the molten metal.

Thus, conventional single straight-pipe type lance has these disadvantages:

(1) that it has its inherent limitations which any attempt to increase the flow velocity of the powder cannot overcome;

(2) that it is liable to considerable fly loss of powder at its front end during lancing operation; and (3) that the area over which streams of powder collide with the molten metal surface is so wide (which means that the powder is widely dispersed) that the depth of powder penetration into the molten metal is limited.

With such lance it is impracticable to allow progressing of various reactions between the powder and the molten metal to more than some limited extent.

OBJECT OF THE INVENTION

It is an object of the invention to provide a powder top-blow refining lance which, without inviting wear of its interior due to powder streams, permits a substantial increase in the flow velocity of the powder when colliding with the molten metal, thus allowing the powder to contact the molten metal for sufficient length of time, and which accordingly permits a substantial increase in the area of their reaction interface and acceleration of their reaction so that a refining time reduction and increased powder penetration can be achieved.

It is another object of the invention to provide a powder top-blow refining lance which permits flexible setting of refining conditions through independent decisions made on the amount of powder addition and the flow velocity of the powder.

It is a further object of the invention to provide a decarburizing and refining process which, by employing said lance, permits production of a high-purity stainless steel or high-manganese steel having a carbon concentration [C] of less than 0.0014% in the steel in molten state, the production of which has hitherto been considered industrially impossible.

The above and further objects and novel features of the invention will more fully be apparent from the following detailed description when the same is read in connection with the accompanying drawings.

DETAILED DESCRIPTION OF THE INVENTION

Having conducted a series of researches directed to overcoming the difficulties as above pointed out with conventional lance, the present inventors found:

(a) that in order to increase the flow velocity of the powder it would be very effective to provide a gas pipe for supply of gas for accelerating powder flow and to effect such acceleration under a vacuum after the powder having been discharged from the conduit, separately from the jetting of carrier gas, the flow velocity of which would be subjected to limitations, if manipulated; and (b) that for that purpose the powder top-blow refining lance should be of double structure, the inner pipe being for supply of gas (carrier gas) incorporating powder in manner as conventionally required, the outer pipe being adapted for jetting gas in the form of jet gas streams through a plurality of Laval nozzles (each having a hole with a center axis inclined at a given angle relative to the center axis of the lance) so that after discharge through the nozzles the powder would be flow-accelerated and converged for penetration deep into the molten metal. These findings led to this invention. Accordingly, the powder top-blow refining lance of the invention comprises a double pipe construction composed of an inner pipe for passage of powder and carrier gas with which the powder is carried and an outer pipe for passage of gas for accelerating the flow of the powder, the front end of the outer pipe being open only through a plurality of Laval nozzle holes.

The Laval nozzle holes should preferably be so angled that gas streams therefrom meet together right beneath the lance to converge the streams of powder. In operation, it will be effective to arrange so that the position for such converging agrees with the surface of the molten metal.

The powder top-blow refining lance of the invention will not be described in more detail with reference to the accompanying drawings.

Figure 1:
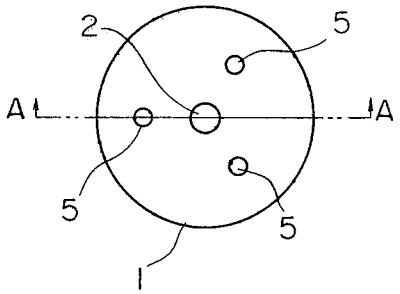
FIG. 1 is a schematic bottom view of a powder top-blow refining lance.
Figure 2:
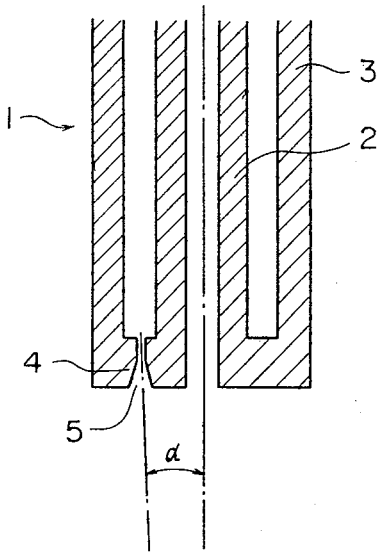
FIG. 2 is a sectional view taken along the line A—A in FIG. 1.

FIG. 1 is a bottom view showing one form of powder top-blow refining lance in accordance with the invention. FIG. 2 is a section taken on the line A—A in FIG. 1. Lance 1 consists of an inner pipe 2 for passage of powder and carrier gas therefor and an outer pipe 3 for passage of powder-flow accelerating gas. The front end 4 of the outer pipe 3 is open only through three Laval nozzle holes 5, and the center axis of each of the Laval nozzle holes 5 is slightly inclined toward the center of the lance. The angle of intersection between the axis of the inner pipe 2 and that of each nozzle hole 5 is shown as $\alpha$ in FIG. 2. Nozzle holes may be four or more in number.

Where such lance is employed, if carrier gas such as Argon (Ar), accompanied with refining powder such as flux, is discharged from the inner pipe 2 and if accelerating gas such as Ar is jetted from the Laval nozzle holes 5 of the outer pipe 3, the powder is flow accelerated by the accelerating gas and converged for penetration deep into the molten metal.

Figure 3:
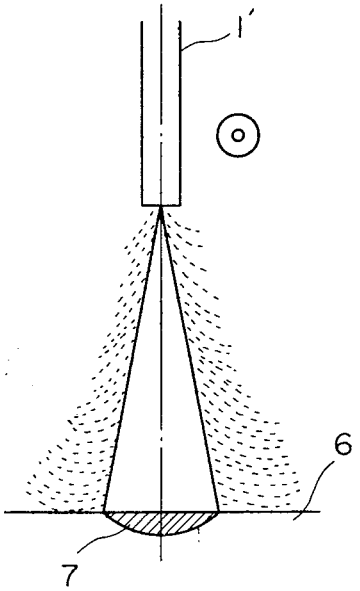
FIG. 3 is an explanatory view illustrating powder being top blown where a conventional lance is employed.
Figure 4:
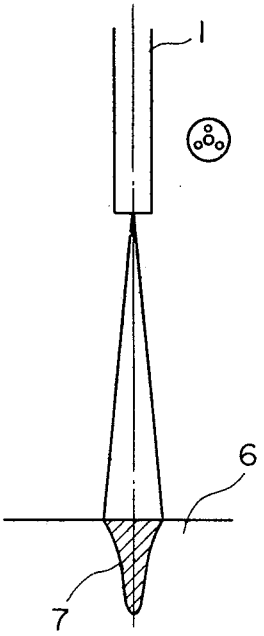
FIG. 4 is an explanatory view illustrating powder being top blown where the lance according to the invention is employed.

FIG. 3 schematically illustrates the condition of powder top blowing where a conventional lance 1' of single straight-pipe type is employed. Likewise, FIG. 4 schematically illustrates the condition of such blowing operation where the lance 1 of the invention is employed. As FIG. 3 shows, with conventional lance, fly losses of powder are unavoidable and the depth of powder penetration into the molten metal 6 is insignificant. Conversely, where the lance of the invention is employed, the powder streams from the nozzle holes are well converged without fly loss and the area of collision on the surface of the molten metal 6 is small as can be clearly seen from FIG. 4. It appears that the powder has penetrated deep into the molten metal. The condition of powder penetration into the molten metal as shown has been assumed on the basis of certain hydro-model tests. A performance comparison between the lance of the invention and conventional lance of single straight pipe type under same conditions showed that in depth of powder penetration the lance of the invention exhibited twice as much performance as the conventional one where powder having a relatively low specific gravity, such as burned lime, and about three times as much performance where powder having a higher specific gravity, such as iron ore.

Figure 5:
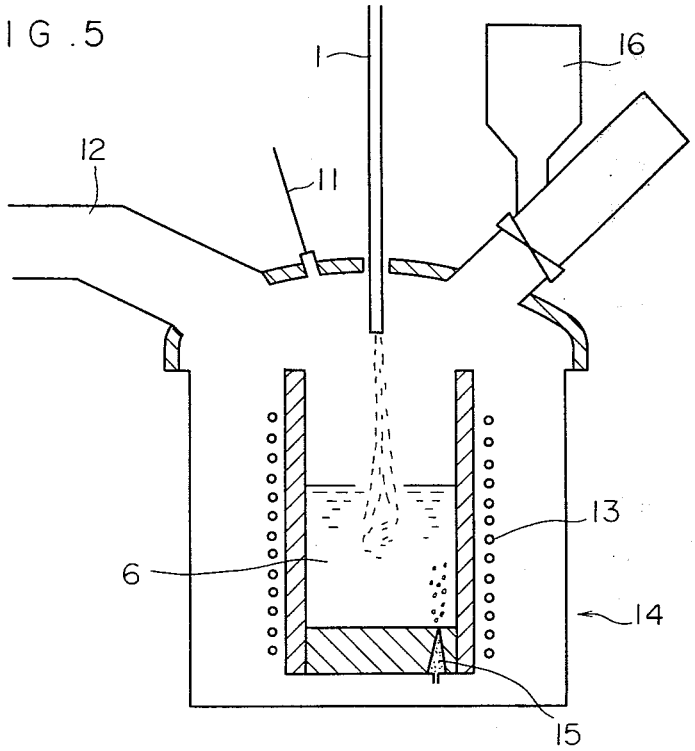
FIG. 5 is a schematic view showing VOD refining being carried out by using the lance of the invention.

Experiments were conducted on vacuum oxygen decarburizing (VOD) of a 19% Cr steel and powder top-blow desulfurizing of same by employing a 2.5-ton vacuum induction furnace energized by high frequency as shown in FIG. 5. Referring to FIG. 5, numeral 11 designates a device for sampling temperature measurement, 12 designates a vacuum duct, 13 designates high-frequency coils, 14 designates a vessel, 15 designates a porous plug, and 16 designates an additive receiving hopper.

The chemical components of crude molten steel from the 19% Cr steel used in the experiments and those of the crude molten steel before and after powder top blowing were as shown in Table 1.

TABLE 1

| | Chemical Component (wt %) | | | | | | |
|---|---|---|---|---|---|---|---|
| | C | Si | Mn | P | S | Cr | Fe + impurity |
| Crude molten steel | 0.80 | 0.22 | 0.20 | 0.012 | 0.010 | 19.0 | rest |
| Prior to powder top blowing | 0.02 | 0.15 | 0.17 | 0.012 | 0.010 | 18.7 | rest |
| After powder top blowing | 0.02 | 0.17 | 0.17 | 0.012 | 0.0002 | 18.8 | rest |

As powder additive was used mixed flux powder including 74 wt % of CaO, 16 wt % of $CaF_2$, and 10 wt % of $SiO_2$.

The lance used was such that the inner pipe 2 thereof, i.e., center nozzle hole was of 5 mm and surrounded by three Laval nozzle holes 5 of 2 mm dia. each, said Laval nozzle holes being angles at $\alpha=3°$. Carrier gas Ar was supplied at the rate of 0.3 $Nm^3$/min·ton, accompanied by flux powder which ws discharged at the rate of 2 kg/min·ton. Through nozzle holes 5 was jetted Ar gas at the rate of 0.45 $Nm^3$/min·ton or at Mach 3.8 to accelerate the flow of the powder. The refining atmospheric pressure was 20 Torr, the temperature of the molten steel during the powder top-blowing experiment was 1600° C., and the distance between the top blowing lance and the molten steel surface (lance height) was 600 mm.

Figure 6:
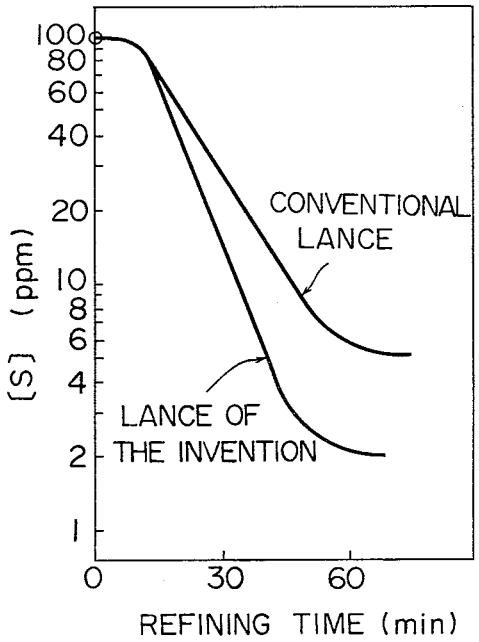
FIG. 6 is a graphic representation showing the progress of desulfurization under vacuum where the lance according to the invention is employed, as compared with that in the case where conventional lance is employed.

FIG. 6 is a graph showing test results on the progress of desulfurization where refining operation was carried out in manner as above described by using the lance of the invention; in comparison with those witnessed where similar operation was performed under the like conditions by using the conventional single straight-pipe type lance. It is apparent from the graph that the lance of the invention exhibits remarkable performance in enhancing the reaction velocity for desulfurization and lowering the attainable sulfur concentration [S] limit.

The lance of the invention is very advantageous when employed in producing extra-low-carbon steel in molten form. The process for producing such steel will now be explained in detail.

Conventionally, extra-low-carbon ferritic stainless steel under vacuum oxygen decarburization process is produced in the following way.

Crude molten steel (having such compositions as, for example, C, 1.2%; Si, 0.30%, Mn, 0.30%; P, 0.026%; S, 0.006%; Cr, 19.0%; O, 0.010%; and N, 0.035%) as manufactured in an electric furnace is transferred in a ladle, and then poured into a vacuum vessel as shown in FIG. 7 for refining.

Figure 7:
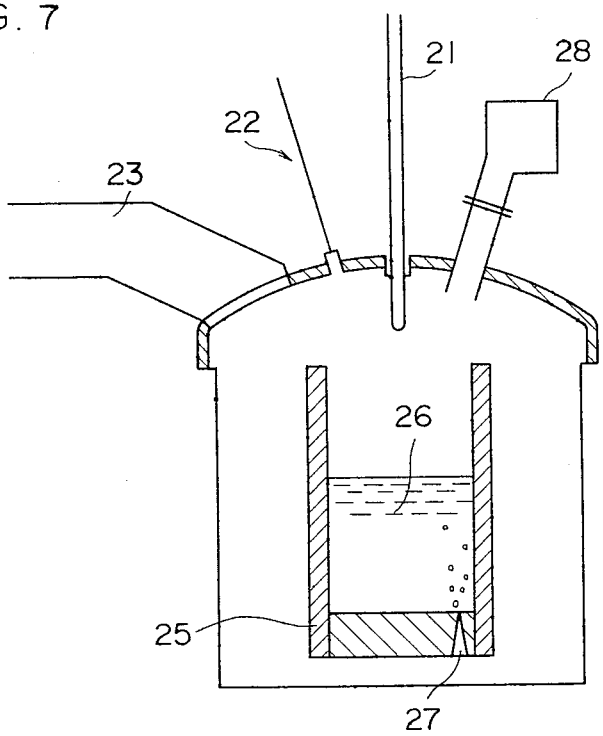
FIG. 7 is an explanatory view illustrating conventional decarburizing and refining process.

In FIG. 7, numeral 21 is gas (oxygen) top-blow decarburizing-refining lance, 22 is a device for sampling temperature measurement, 23 is a vacuum duct, 25 is a molten-steel receiving vessel, 26 is molten steel, 27 is an agitation-gas (Ar or the like) supply porous plug, and 28 is a hopper with additive received therein. Refining in this vessel is carried out in such a way that oxygen top blowing is performed for decarburization while agitation gas being supplied through the porous plug under a pressure of 130~0.6 Torr.

Steel produced under such conventional VOD process is substantially of the following composition, if the crude molten steel is of such composition as above described:

C, 0.02~0.06%; Si, 0.10~0.20%; Mn, 0.10~0.20%; P, 0.026~0.027%; S, 0.005~0.006%; Cr, 18.0~18.7%; O, 0.065%; N, 0.008%.

As a decarburizing and refining process for further reducing the C content in the steel there is available a high-vacuum decarburizing method wherein decarburization is carried out by using as an oxygen source the chromium oxide produced on the surface of the molten steel during oxygen top blowing operation.

Now, the decarburizing rate during this treatment depends on the concentration of C at that time, and therefore, the lower the C concentration, the lower is the decarburizing rate. As such, it takes much considerable time to obtain an extra-low-carbon molten steel. In order to reduce this time requirement, the C concentration prior to the stage of high-vacuum decarburization should be lowered as much as possible. However, if decarburization is carried out through oxygen blowing prior to high-vacuum decarburizing operation, chromium oxide that may be produced beginning from the moment when the concentration of C is reduced to a 0.1~0.4% level will likely deposit in bulk on the surface of the molten steel, which fact makes it difficult to have agitation carried out of the molten steel and slag in the subsequent high-vacuum decarburization stage. Thus, insufficient agitation, decreased decarburizing rate, and eventual longer time of treatment. The C concentration in the molten steel obtainable by such method is 0.008~0.012% at the best.

To overcome these difficulties, two methods have been proposed. One is such that large amounts of gas for agitation are introduced from the bottom of the ladle at several points into the molten steel, agitation being vigorously effected, whereby reaction is accelerated between the molten steel and the chromium oxide deposited on the surface of the molten steel. The other method is such that the chromium oxide deposited on the surface of the molten steel is decreased to a suitable level by reducing some portion thereof or slag of high concentration with Fe-Si or the like, then flux being added to produce fluid slag of $CaO\text{-}SiO_2\text{-}Cr_2O_3$ having a low melting point and some oxidizing power.

Where either of the above two methods is employed, the molten steel produced may have a C concentration of 0.005% or below, but these methods involve the following problems. With the former method, the difficulty is that it may increase the possibility of melting or spalling at a multiplicity of gas inlet ports provided at the bottom of the ladle or peripheral refractories. Further, it may involve increased danger of molten steel leak. Therefore, it is questionable in many respects to employ the method in actual operation. The latter method may be effective for the purpose of providing slag fluidity, but it has a drawback in that as the amount of additive increases, the concentration of chromium is liable to decrease, which will naturally result in a decrease in oxidizing ability. As such, with this latter method it is difficult to produce proper slag in actual operation.

Now, if the powder top-blow refining lance of the invention is employed, it is possible to overcome all such difficulties with the prior art as above pointed out by jetting streams of decarburizing and refining additive onto the surface of the molten steel at such velocity as will permit such additive to enter deep into the molten steel.

Suitable for use as decarburizing and refining additive is any powder containing one or more kinds selected from the group consisting of oxides of such materials as chromium, iron, manganese, and nickel. Either inert gas such as Ar or other gas such as nitrogen gas $N_2$ may be used as carrier gas. Accelerating gas jetting through the Laval nozzle holes should be of supersonic velocity; and the degree of penetration of the gas into the molten steel, which is expressed by the equation $$\text{Powder penetration ratio (\%)} = \left( \frac{\text{Depth of powder penetration}}{\text{Depth of molten steel}} \right) \times 100$$

should preferably be set at 20% or above by suitably selecting lance height and other necessary factor. In any case, it should be 15% or more.

In a portion at least of the under-vacuum decarburizing and refining process, it is possible to further enhance the reaction between the additive and the molten steel by introducing refining or agitating gas beneath the surface of the molten steel.

Figure 8:
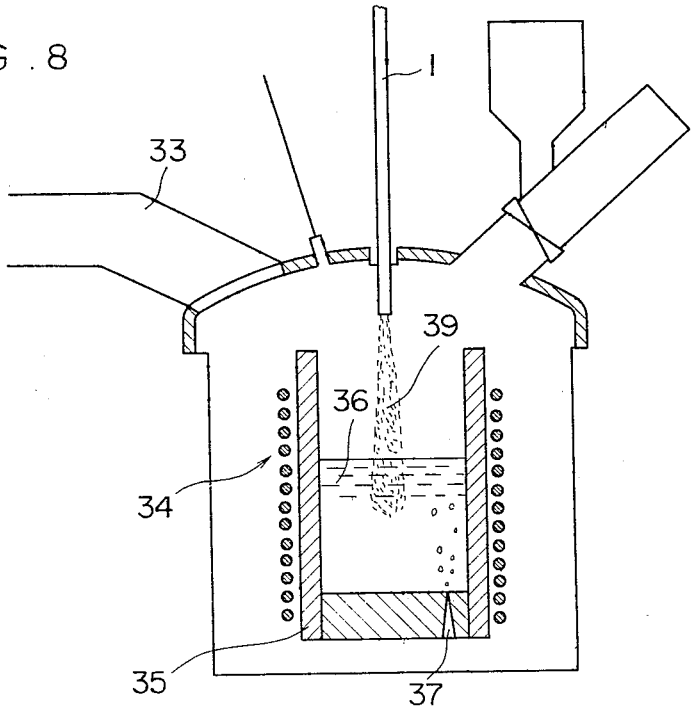
FIG. 8 is an explanatory view illustrating steel decarburizing and refining operation in progress according to the process of the invention.

The process for decarburizing and refining steel in accordance with the invention will now be described with reference to one example in which the invention was applied for the purpose of VOD 19% Cr steel employing a vacuum induction furnace (capacity: 2.5 ton) as shown in FIG. 8.

This VOD process includes a decarburizing stage in which oxygen is top blown onto the crude molten steel. In the low-carbon zone of the decarburizing stage some Cr is oxidized and allowed to deposit in the form of solid chromium oxide on the surface of the molten steel.

For the purpose of producing extra-low-carbon steel in molten form, the decarburizing and refining operation is carried out by employing the method of powder top-blowing according to the invention after oxygen top blowing is effected and before chromium oxide accumulates on the surface of the molten steel in the low-carbon zone.

Molten steel 36 was maintained at 1600° C. by high-frequency energizing coils 34 arranged on vessel 35 of the vacuum induction furnace shown in FIG. 8. Gas is discharged through the vacuum duct 33 to maintain vacuum at 20 Torr. As decarburizing powder 39 for jetting onto the surface of the molten steel 36 was used a powder mixture composed of 95% $Cr_2O_3$, 4% $TiO_2$, and 1% other, for example, and having a particle size of 200 mesh or below. The powder was jetted from the top blowing lance 1 of the invention onto the molten steel at a high velocity, with argon (Ar) used as carrier gas.

Like the one shown in FIGS. 1 and 2, the lance 1 had three Laval nozzle holes 5, each having a diameter of 2 mm and an inclination angle of 3°. With Ar as carrier gas, decarburizing powder was jetted at Mach 1 (under vacuum at 20 Torr) from a center nozzle hole associated with an inner pipe 2, said nozzle hole having a diameter of 5 mm. At Mach 3.8 (under vacuum at 20 Torr) streams of Ar gas were blown from a nozzle 5 to accelerate the flow velocity of decarburizing powder blown from the center nozzle hole.

The pressure of Ar gas from the center nozzle hole was set at 3 kg/cm$^2$, and the flow rate of the gas at 0.2~0.4 Nm$^3$/min·ton. The pressure of Ar gas from nozzle holes 5 were set at 5 kg/cm$^2$, with the flow rate of the gas at 0.45 Nm$^3$/min·ton. The feed rate of the decarburizing powder was 0.20~0.05 kg/min·ton, and the supply amount of same was 6.7 kg/ton (provided that the feed rate was gradually decreased allowing for the effect of penetration of the powder into the molten steel and the velocity of decarburizing reaction). The distance between the lower end of the top blowing lance 1 and the surface of the molten steel 36 was maintained at 600 mm. Through a porous plug 37 at the bottom of the vessel 35 was blown Ar gas for agitation at the rate of 2~7 Nl/min·ton.

TABLE 2

| Component element | C | Si | Mn | P | S | Cr |
|---|---|---|---|---|---|---|
| Crude molten steel | 0.80 | 0.20 | 0.20 | 0.012 | 0.010 | 19 |
| Before powder top blowing | 0.020 | 0.15 | 0.18 | 0.012 | 0.010 | 19 |
| After powder top blowing | 0.0008 | 0.13 | 0.15 | 0.012 | 0.010 | 19 |

Unit: %

Figure 9:
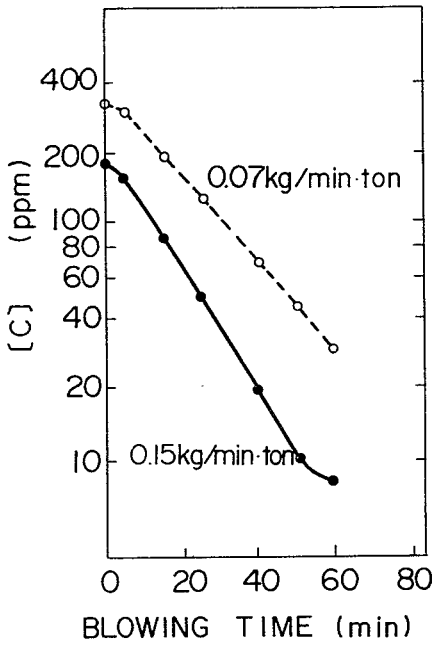
FIG. 9 is a graph showing the relation between powder feed rate and transition of [C].

Table 2 shows the composition of the molten steel prior to decarburization, and composition of same before powder top blowing or after completion of oxygen blowing and composition after completion of powder top blowing. FIG. 9 presents transition of C concentration [C] in the molten steel during the process of decarburizing powder ($Cr_2O_3$: 95%) being top blown. In the Figure, continuous line refers to the case of powder feed at 0.15 kg/min·ton and broken line refers to the case of powder feed at 0.07 kg/min·ton. As can be seen from Table 2 and FIG. 9, the level of [C] 0.0008% was achieved in a comparatively short time. During the process of decarburizing-powder top blowing, no build-up of solid chromium oxide was observed or the surface of the molten steel, and the vigorous stirring of the molten steel and also vigorous stirring of the motlen steel-slag were carried out successfully.

Figure 10:
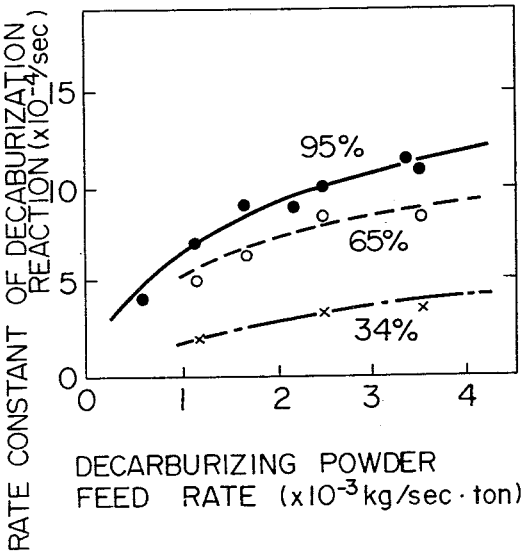
FIG. 10 is a graphic representation showing the relation between feed rate of decarburizing agent (decarburizer) powder and rate constant of decarburization reaction.

FIG. 10 shows the effect of decarburizing powder feed rate upon the decarburizing rate constant of decarburization reaction. In the Figure, continuous line refers to the case of 95% $Cr_2O_3$ in the decarburizing powder, broken line to the case of 65% $Cr_2O_3$ therein, and alternate long and short dash line to the case of 34% $Cr_2O_3$ therein. It can be understood from the Figure that the rate constant of decarburization reaction increases as the feed rate of decarburizing powder increases. Build-up of slag including solid chromium oxide was observed on the surface of the molten steel when the feed rate of decarburizing powder exceeded $3\times10^{-3}$ kg/sec·ton.

Figure 11:
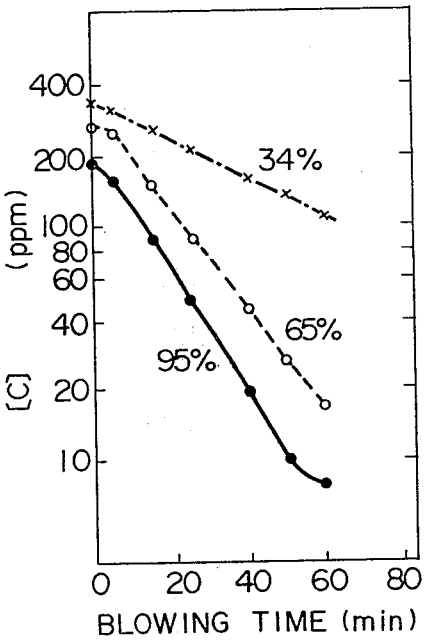
FIG. 11 is a graph showing the effect of chrome oxide mix rate upon the rate of decarburizing.

FIG. 11 shows the effect of chromium oxide content of the decarburizing powder upon decarburizing rate. In the Figure, continuous line refers to the case of 95% of $Cr_2O_3$ (other component 5%) in the decarburizing powder, broken line to the case of 65% $Cr_2O_3$ (with MgO at 33% and other at 2%) therein, and alternate long and short dash line to the case of 34% $Cr_2O_3$ (with MgO at 63% and other at 3%) therein. It is noted that the data given refers to the case where supply rate of decarburizing powder is 0.15 kg/min·ton. It is apparent from the Figure that the rate of decarburization becomes remarkably low when the chromium oxide content is reduced. This can be seen from FIG. 10 as well.

Therefore, when decarburizing and refining operation is carried out to reduce the carbon content to an extremely low level as described in the present instance, it is noted, the higher the concentration of chromium oxide in the carburizing powder and the greater the supply rate of decarburizing powder, the greater is the decarburizing rate, and thus it is possible to achieve a [C] level of 0.0014% or below in a short time. Considering the need for vigorous stirring of the molten steel as well as for vigorous stirring of the molten steel-slag, however, it is undesirable to use an excessively high rate of decarburizing powder supply. As a marginal condition which can control build-up of slag including chromium oxide, the following was obtained: $3\times10^{-3}$ kg/sec·ton.

Figure 12:
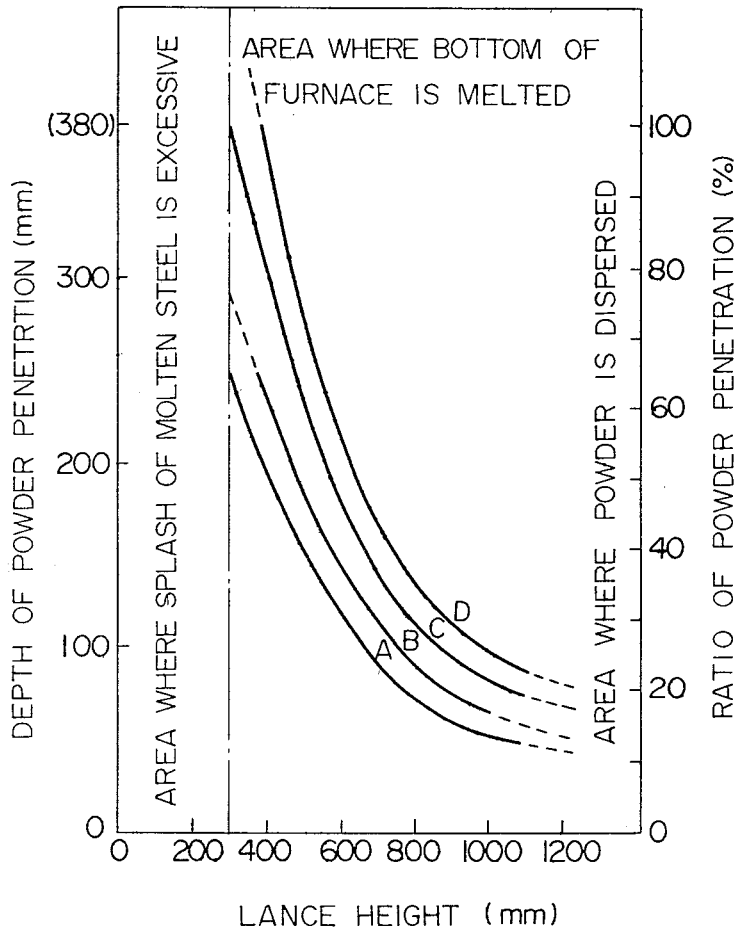
FIG. 12 is a graph showing the relation between lance height and depth of powder penetration.

In the method of decarburizing and refining according to the invention, one important consideration is selection of the depth of penetration of powder into the molten steel. FIG. 12 is a graph showing the relation between lance height and depth or ratio of powder penetration, which relationship was determined by using iron ore powder as additive and powder supply rate and flow rate of carrier gas as parameters. Tests were conducted by using a model simulating a 2.5-ton furnace. Values of powder supply rate (kg/min·ton) and carrier-gas flow rate (Nm$^3$/min·ton) corresponding to lines A, B, C and D in the Figure are as shown in Table 3.

TABLE 3

| | Supply rate of powder | Carrier-gas flow rate |
|---|---|---|
| A | 0.7 | 0.3 |
| B | 0.7 | 0.6 |
| C | 1.4 | 0.3 |
| D | 1.4 | 0.6 |

As the graph shows, a lance height of less than 300 mm is not suitable for the purpose of refining, because it may result in excessive molten steel splash. A powder penetration to the extent that powder reaches the bottom of the furnace is also unsuitable, because it may be a cause of bottom melting. If the penetration ratio is less than 15%, there may be fly loss of powder and the desired refining effect cannot be obtained.

As such, by suitable selection of lance height, powder feed rate, carrier-gas flow rate or accelerating gas velocity, powder penetration ratio should be more than 15%, or preferably more than 20%. To obtain powder penetration ratio of more than 20%, lance height should be 1,000 mm or less, depending upon other condition such as accelerating gas velocity, though. Therefore, a suitable range of lance heights should be 300~1,000 mm.

Figure 13:
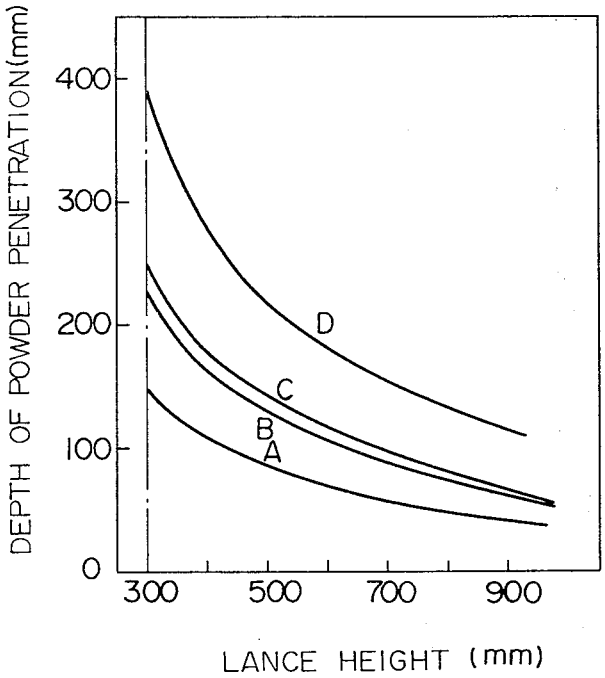
FIG. 13 is a graphic representation showing test results on the effect of powder feed rate upon the depth of powder penetration.
Figure 14:
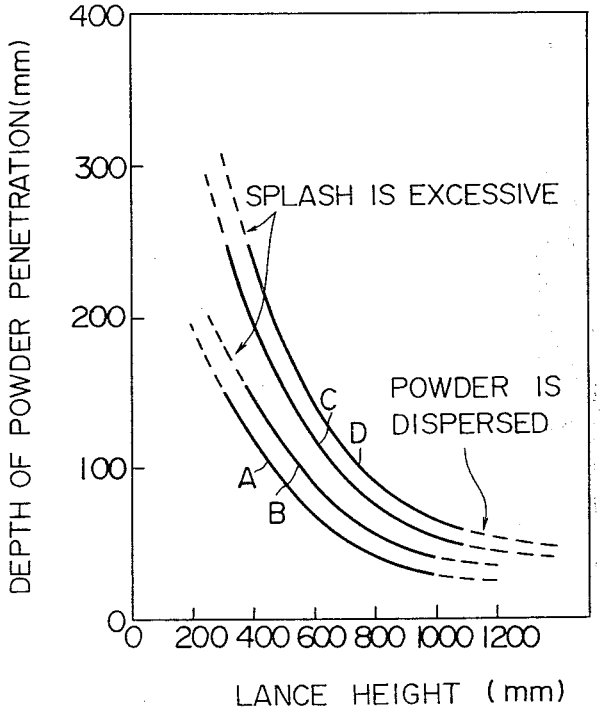
FIG. 14 is a graph showing test results on the effect of carrier gas flow rate upon the depth of powder penetration.

Powder penetration depth may be influenced by the rate of powder supply and flow rate of carrier gas. Penetration depth becomes deeper as these rates increase. This is apparent from FIG. 12. FIGS. 13 and 14 show the results of tests conducted to clarify the extent of these influences.

Tests were made by employing a model simulating a 2.5-ton furnace. FIG. 13 shows the relation between lance height and powder penetration depth as determined with respect to each of the following powder supply rates:

A, burned lime 2 kg/min·ton, B, burned lime 4 kg/min·ton, C, iron ore 0.7 kg/min·ton, and D, iron ore 1.4 kg/min·ton. The flow rate of carrier gas is 0.3 $Nm^3$/min·ton.

As can be seen from the Figure, if the power supply rate is doubled, the power penetration depth will be increased to as much as 1.5 times.

FIG. 14 shows the relation between lance height and powder penetration depth as determined in the following cases: A, B, iron ore supplied at the rate of 0.7 kg/min·ton, C, D, burned lime supplied at the rate of 2 kg/min·ton, A, C, carrier-gas flow rate 0.3 $Nm^3$/min·ton, B, D, carrier-gas flow rate 0.6 $Nm^3$/min·ton. As can be seen from the Figure, if the carrier-gas flow rate is doubled, the powder penetration depth will be increased to about 1.2 times.

In actual operation, therefore, lance height should be determined and adjusted allowing for these factors.

Next, an example in which the invention is applied in VOD refining carbon steel will be explained.

Figure 15:
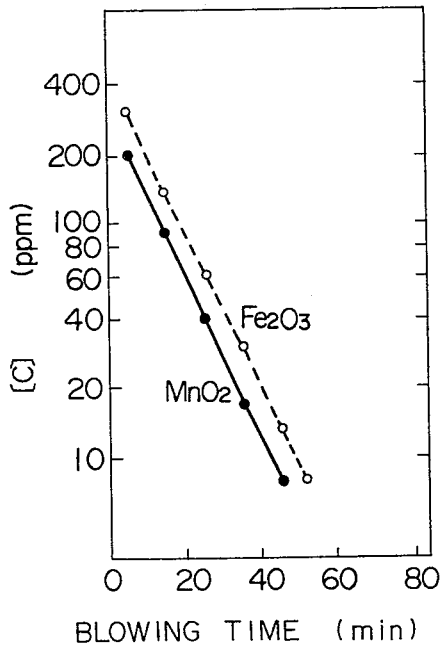
FIG. 15 is a graph showing transition of [C] during refining operation with carbon steel in accordance with the process of the invention.

FIG. 15 shows decarburizing behaviors of manganese oxide and iron oxide where these materials in powder form were used in top blowing as decarburizers. Continuous line refers to the case where a powder material having a 97% manganese oxide ($MnO_2$) content was used as decarburizer, and broken line refers to the case where a powder material having a 96% iron oxide ($Fe_2O_3$) content was used as decarburizer. Table 4 shows the composition of crude molten steel in the case where manganese oxide in powder form was used as decarburizer in top blowing, and pre-top-blowing and post-top-blowing compositions of same. Table 5 shows the composition of crude molten steel in the case where iron oxide powder was used as decarburizer in top blowing, and compositions of same before and after top blowing. As is the case with the earlier described example, it was found that the level of [C] 0.0014% or below could easily be attained.

TABLE 4

| Component element | C | Si | Mn | P | S |
|---|---|---|---|---|---|
| Crude molten steel | 0.77 | 0.17 | 1.70 | 0.006 | 0.004 |
| Before powder top blowing | 0.03 | 0.10 | 1.05 | 0.006 | 0.004 |
| After powder top blowing | 0.0008 | 0.05 | 1.12 | 0.006 | 0.004 |

Unit: %

TABLE 5

| Component element | C | Si | Mn | P | S |
|---|---|---|---|---|---|
| Crude molten steel | 0.75 | 0.18 | 0.43 | 0.011 | 0.005 |
| Before powder top blowing | 0.03 | 0.16 | 0.30 | 0.011 | 0.005 |
| After powder top blowing | 0.008 | 0.10 | 0.25 | 0.011 | 0.005 |

Unit: %

Figure 16:
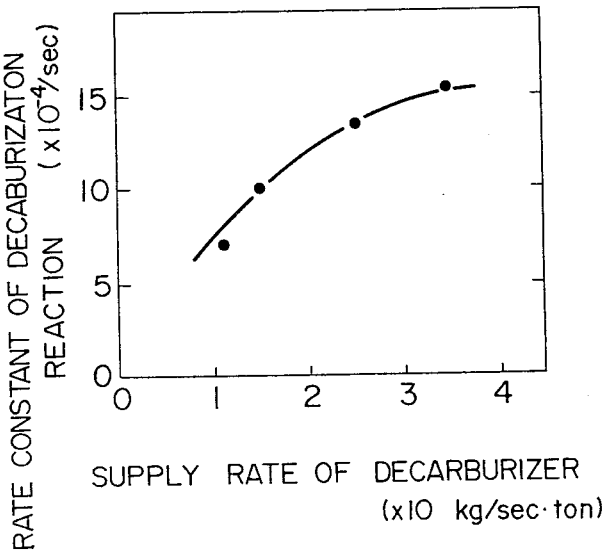
FIG. 16 is a graphic representation showing the relation between the feed rate of decarburizing agent and rate constant of decarburization reaction.

FIG. 16 shows the effect of manganese oxide ($MnO_2$: 97%) powder supply rate upon decarburization rate constant. Like in the earlier described example, it was found that the rate constant of decarburization reaction increased as the supply rate of decarburizer powder increased.

As described above, according to the decarburizing method of the invention, it is possible to permit the powder decarburizer to penetrate effectively into the molten steel in under-vacuum refining. Therefore, the present invention makes it possible to produce high-purity stainless steel or high-manganese steel in molten state, for example, such that [C] is 0.0014% or below, which level has been considered industrially unattainable.

As this invention may be embodied in several forms without departing from the spirit of essential characteristics thereof, the present embodiment is therefore illustrative and not restrictive, since the scope of the invention is defined by the apended claims rather than by the description preceding them, and all changes that fall within metes and bounds of the claims, or equivalence of such metes and bounds thereof are therefore intended to embraced by the claims.

What is claimed is:

1. A powder top-blow refining lance for metal refining under vacuum, comprising a double pipe structure consisting essentially of inner pipe means for passing a powder and a carrier gas in which the powder is carried and outer pipe means for passing an accelerating gas, a nozzle hole disposed at the front end of said lance and connected to the inner pipe means, and a plurality of Laval nozzle holes disposed around said nozzle hole and connected to the outer pipe means, said Laval nozzle holes being constructed and arranged such that the accelerating gas which has passed therethrough causes convergence of the powder which has passed through the inner pipe means and out the nozzle hole.

2. A process for decarburizing and refining steel under vacuum, characterized by employing a powder top-blow refining lance having a double pipe structure consisting essentially of inner pipe means for passing a powder and a carrier gas in which the powder is carried and outer pipe means for passing an accelerating gas, a nozzle hole disposed at the front end of said lance and connected to the inner pipe means, and a plurality of Laval nozzle holes disposed around said nozzle hole and connected to the outer pipe means, blowing decarburizing and refining additive from the nozzle hole connected to the inner pipe means, blowing accelerating gas from the Laval nozzle holes at supersonic speed whereby the accelerating gas causes convergence of the powder which has passed through the inner pipe means and out the nozzle hole and wherein the ratio of powder penetration into the molten steel is more than 15%.

3. A process for decarburizing and refining steel as set forth in claim 2 wherein the carrier gas is an inert gas.

4. A powder top-blow refining lance set forth in claim 1 wherein the Laval nozzle holes are angled such that the accelerating gas streams meet beneath the lance.

5. A process for decarburizing and refining steel as set forth in claim 2, wherein the carrier gas with which said additive is carried is (are) a gas (gases) for refining.

6. A process for decarburizing and refining steel as set forth in claim 2, wherein in at least one part of the decarburizing and refining process some gas for refining and stirring purposes is introduced beneath the surface of the molten steel.

7. A process for decarburizing and refining steel as set forth in claim 5, wherein in at least one part of the decarburizing and refining process some gas for refining and stirring purposes is introduced beneath the surface of the molten steel.

* * * * *